US007542905B2

(12) United States Patent
Kondo

(10) Patent No.: US 7,542,905 B2
(45) Date of Patent: Jun. 2, 2009

(54) METHOD FOR SYNTHESIZING A VOICE WAVEFORM WHICH INCLUDES COMPRESSING VOICE-ELEMENT DATA IN A FIXED LENGTH SCHEME AND EXPANDING COMPRESSED VOICE-ELEMENT DATA OF VOICE DATA SECTIONS

(75) Inventor: Reishi Kondo, Tokyo (JP)

(73) Assignee: NEC Corporation, Tokyo (JP)

( * ) Notice: Subject to any disclaimer, the term of this patent is extended or adjusted under 35 U.S.C. 154(b) by 1005 days.

(21) Appl. No.: 10/106,054

(22) Filed: Mar. 27, 2002

(65) Prior Publication Data

US 2002/0143541 A1 Oct. 3, 2002

(30) Foreign Application Priority Data

Mar. 28, 2001 (JP) ..... 2001-091560

(51) Int. Cl.
*G10L 13/00* (2006.01)

(52) U.S. Cl. ..... 704/258

(58) Field of Classification Search ..... 704/258
See application file for complete search history.

(56) References Cited

U.S. PATENT DOCUMENTS

| | | | | |
|---|---|---|---|---|
| 4,214,125 | A * | 7/1980 | Mozer et al. | 704/268 |
| 4,384,169 | A * | 5/1983 | Mozer et al. | 704/206 |
| 4,458,110 | A * | 7/1984 | Mozer | 704/211 |
| 4,764,963 | A * | 8/1988 | Atal | 704/219 |
| 5,633,983 | A * | 5/1997 | Coker | 704/260 |

FOREIGN PATENT DOCUMENTS

| | | |
|---|---|---|
| JP | 05-073100 | 3/1993 |
| JP | 08-1609911 | 6/1996 |

* cited by examiner

*Primary Examiner*—Talivaldis Ivars Smits
(74) *Attorney, Agent, or Firm*—Whitham Curtis Christofferson & Cook, PC

(57) ABSTRACT

A method for synthesizing a voice waveform includes compressing voice-element data in a fixed length scheme that uses data from a preceding or succeeding frame. The compressed voice-element data of each voice section is expanded, and the preceding or succeeding frame of the expanded voice-element data is discarded. The remaining voice-element data is synthesized after discarding portions of the expanded voice-element data.

19 Claims, 8 Drawing Sheets

METHOD FOR SYNTHESIZING A VOICE WAVEFORM WHICH INCLUDES COMPRESSING VOICE-ELEMENT DATA IN A FIXED LENGTH SCHEME AND EXPANDING COMPRESSED VOICE-ELEMENT DATA OF VOICE DATA SECTIONS

BACKGROUND OF THE INVENTION (a) Field of the Invention

The present invention relates to a voice rule-synthesizer and a compressed voice-element data generator and, more particularly, to techniques for synthesis of voice waveform by rule based on compressed voice-element and for generation of compressed voice-element data for use in the synthesis.

The present invention also relates to a method for synthesizing a voice waveform by using a plurality of original voice data.

(b) Description of the Related Art

A waveform edition scheme is generally used for synthesis of voice waveforms by rule, i.e., for voice rule-synthesis. In this scheme, although a high voice quality is obtained with relative ease compared to other techniques, there is a problem in that a storage capacity used for storing voice elements, called original waveforms, is large because a large amount of original waveforms should be stored for creating different synthesized voice waveforms therefrom. The large storage capacity raises the cost for the voice synthesis by rule.

In order to solve the problem of the large storage capacity, conventional techniques attempt to use a compression scheme for compressing the voice elements. Patent Publication JP-A-8-160991, for example, describes such a technique, wherein a difference between adjacent pitches is stored instead of the voice element in a memory for reducing the storage capacity.

Patent Publication JP-A-5-73100 describes a technique wherein a vector quantization is conducted only for spectrum information to create compressed parameter patterns, which are stored in a code book.

In the conventional techniques as described above, it is difficult to compress the voice element with a higher degree of compression factor while suppressing degradation of the voice quality. In particular, since the voice elements used for voice synthesis are generally collected from a plurality of separate voice data, there exist a large number of short voice data sections corresponding to the separate voice data. The short voice data section generally involves a large compression distortion especially in the vicinity of the start point of the voice data section if a large compression factor is used. This raises the overall distortion of the resultant synthesized voices including a large number of voice data sections, and degrades the voice quality of the synthesized voices.

SUMMARY OF THE INVENTION

In view of the above problem in the conventional technique, it is an object of the present invention to provide a voice rule-synthesizer for generating a synthesized voice waveform having a high voice quality without significantly increasing the storage capacity of the storage device for the voice elements.

It is another object of the present invention to provide a compressed voice-element data generator used for the voice rule-synthesizer of the present invention.

It is a further object of the present invention to provide a method for synthesizing a voice waveform based on compressed voice-element data.

The present invention provides a compressed voice-element data generator including a compression section for compressing a voice waveform of each voice data section by using fixed-length frames and historical data to generate compressed voice-element data, and a database for storing the compressed voice-element data while arranging the compressed voice-element data of a plurality of voice data sections in a data stream.

The present invention also provides a voice rule-synthesizer including a voice-element data read section for reading and extending compressed voice-element data of a voice data section stored in a database, the database storing a single data stream including a plurality of consecutive voice data sections each stored as a plurality of frames, and a waveform generator for synthesizing a voice waveform based on the voice-element data of a desired number of the frames extended by the voice-element read section.

The present invention further provides a method for synthesizing a voice waveform including the steps of: compressing a voice waveform of each voice data section by using fixed-length frames and historical data to generate compressed voice-element data, storing the compressed voice-element data while arranging the compressed voice-element data of a plurality of voice data sections in a data stream, extending the compressed voice-element data of each voice data section to generate an extended voice-element data, and synthesizing a voice waveform based on the extended voice-element data.

In accordance with the present invention, the voice data of a plurality of voice data sections are stored in a single data stream after compression, whereby the storage capacity for storing the voice-element data can be reduced, substantially without degrading the voice quality.

The above and other objects, features and advantages of the present invention will be more apparent from the following description, referring to the accompanying drawings.

BRIEF DESCRIPTION OF THE DRAWINGS

FIG. 2B illustrates a data diagram of compressed voice-element data stored in the compressed voice-element database, both the diagrams being according to a second embodiment of the present invention.

PREFERRED EMBODIMENTS OF THE INVENTION

Now, the present invention is more specifically described with reference to accompanying drawings.

Figure 1:
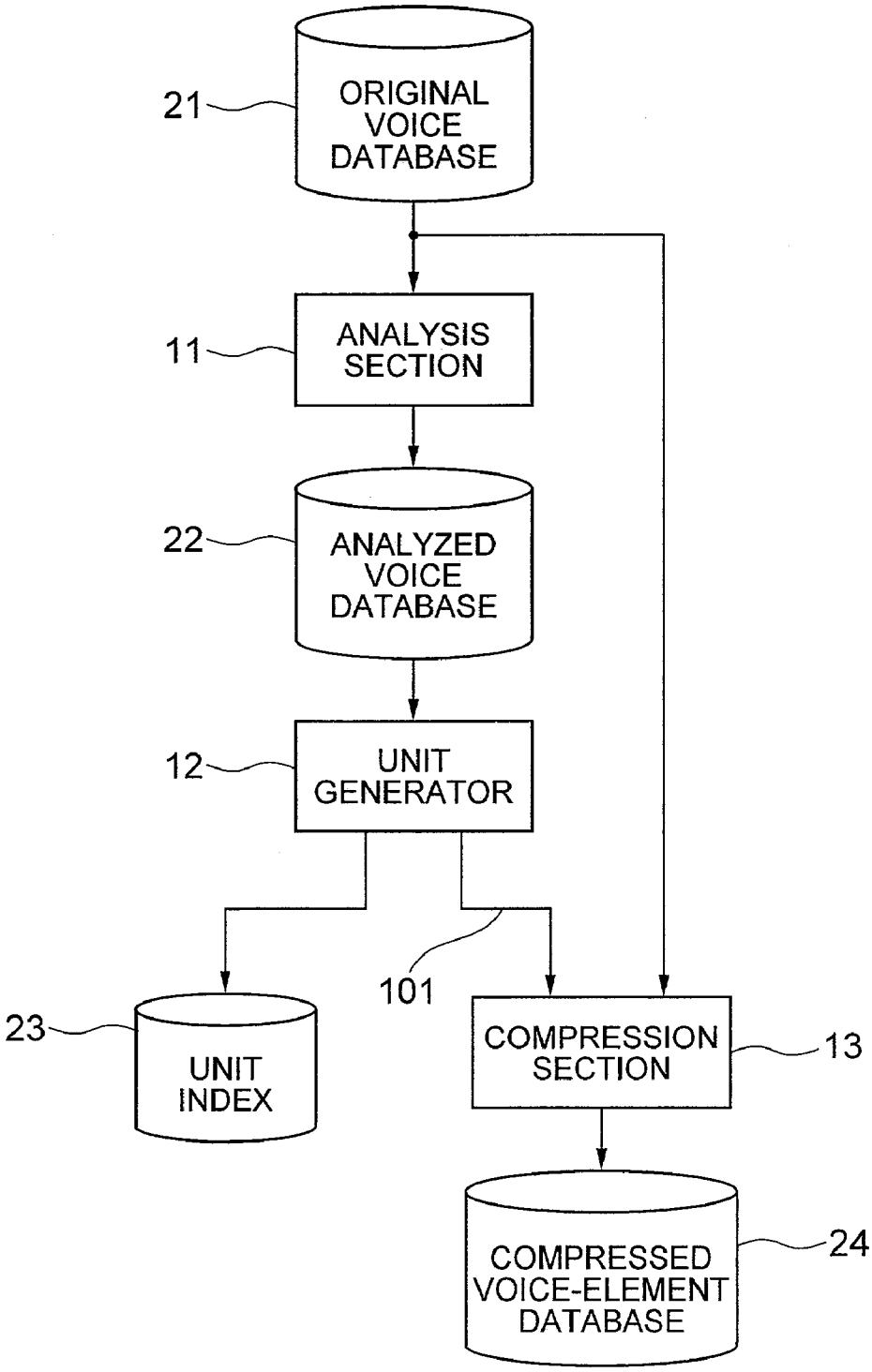
FIG. 1 is a block diagram of a compressed voice-element data generator according to a first embodiment of the present invention.

Referring to FIG. 1, a compressed voice-element data generator according to a first embodiment of the present invention includes an analysis section 11, a unit generator 12, a compression section 13, and databases including original voice database 21, analyzed voice database 22, a unit index 23 and a compressed voice-element database 24.

The original voice database 21 stores a variety of original voice data having respective data sections, obtained from a person and recorded beforehand. The variety of voice data may include thousands of voice data, for example, such as having different tones, tempos and intonations of voice data. The analysis section 11 receives the original voice data from the original voice database 21, analyzing the received voice data to generate analysis data, which are stored in the analyzed voice database 22 together with the original voice data. The analysis data include labeling of the voice data and candidate boundaries between units of the voice data.

The unit generator 12 detects a plurality of units from the original voice data based on the analysis data stored in the analyzed voice database 22. The term "unit" as used herein corresponds to a specific meaning of pronunciation. A combination of consonant and a beginning part of a vowel succeeding to the consonant corresponds to a unit, for example, and the remaining part of the vowel corresponds also to another unit. The unit generator 12 attaches an index to each of the detected units, the index specifying the location information of the unit to be stored in the voice-element database 24. The unit and the index or location information are stored in the unit index 23.

The compression section 13 receives the location information 101 as well as the original voice data from the unit generator 12 to compress the voice data, frame by frame, on a fixed-length frame basis. The compression section 13 has a function for storing the compressed voice elements of a plurality of voice data sections as a single data stream in the voice-element database 24. The compressed voice-element database thus stores a plurality of voice-element data in a frame format as the single data stream.

Figure 2A:
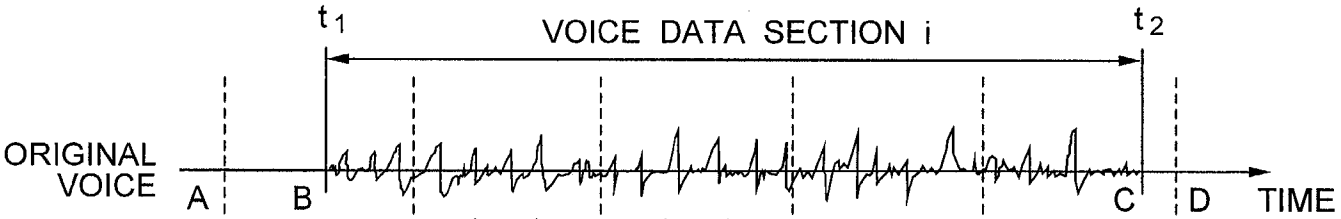
FIG. 2A illustrates a waveform diagram of the voice data stored in the voice database shown in FIG. 1.
Figure 2B:
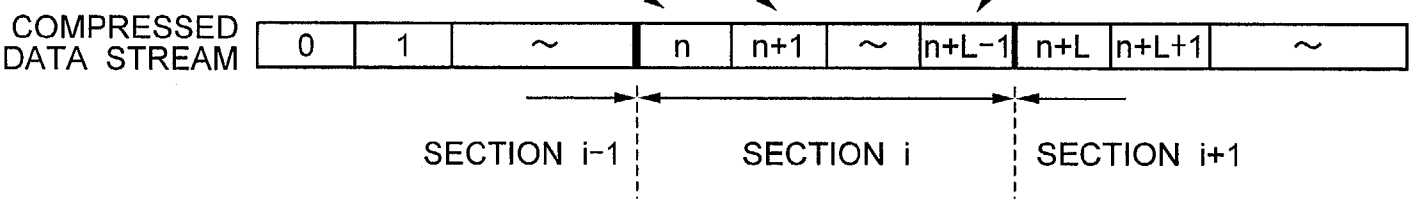
FIG. 2B illustrates a data diagram of compressed voice-element data stored in the compressed voice-element database shown in FIG. 1, both the diagrams being according to the first embodiment of the present invention.

The data compression by the compression section 13 in the fixed-length frame basis will be described with reference to FIGS. 2A and 2B, which illustrate, respectively, a the waveform of the original voice data stored in the original voice database 21, and the compressed voice elements stored as a data stream in the compressed voice-element database 23.

The compression section 13 first determines the start time t1 and the end time t2 of the voice data, then determines a combination of L frames including n-th, (n+1)-th, (n+2)-th, . . . , and (n+L−1)-th frames, each having a fixed time length, and receiving therein a corresponding part of the original voice data. In FIGS. 2A and 2B, it is to be noted that the start point of the starting n-th frame of a voice data section "i" is point A, whereas the original voice data starts at t1 or point B, which resides within the starting n-th frame. Prior to the n-th frame and succeeding to the (n+L−1) frame of the voice data section "i", the data stream includes other compressed voice data sections "i−1" and "i+1" obtained from another voice data. These voice data are stored section by section in the database 24, wherein a plurality of data sections are stored consecutively.

After determining the combination of frames, the compression section 13 resets the historical data, or the prior voice data, then compresses the voice data in the frames starting from the n-th frame to the (n+L−1)-th frame, generating a series of compressed voice elements as a bit stream including L data sets. In this step, the compression section 13 compresses fixed-length frames while using historical data to obtain compressed fixed-length data.

The term "using historical data" as used herein means that the compression scheme uses preceding N frame data during compression of the current frame data, N being determined beforehand for achieving a specified voice quality. Examples of such a compression scheme include adaptive differential pulse code modulation (ADPCM), code excited linear prediction (CELP), and vector sum excited linear prediction (VSELP).

In a practical process for generation of units, a plurality of voice sections are extracted from a variety of voice data to form a data stream of the voice-element data. After the extraction, a plurality of compressed bit stream sections each corresponding to a single voice section are combined together to form a single data stream in the voice-element database 24. The fixed-length compressed data allows the voice-element data to be efficiently retrieved in the voice-element database 24 by using the frame number (sequential number) of the head frame and the number of the frames to follow.

In view of the above, information for the head frame number and the number of following frames is stored in the unit index 23. In addition, the offset between the beginning of the head frame, such as point A, and the starting point of the voice data section, such as point B, as well as the length of the voice data section is stored in association with the corresponding units in the unit index 23.

Figure 3:
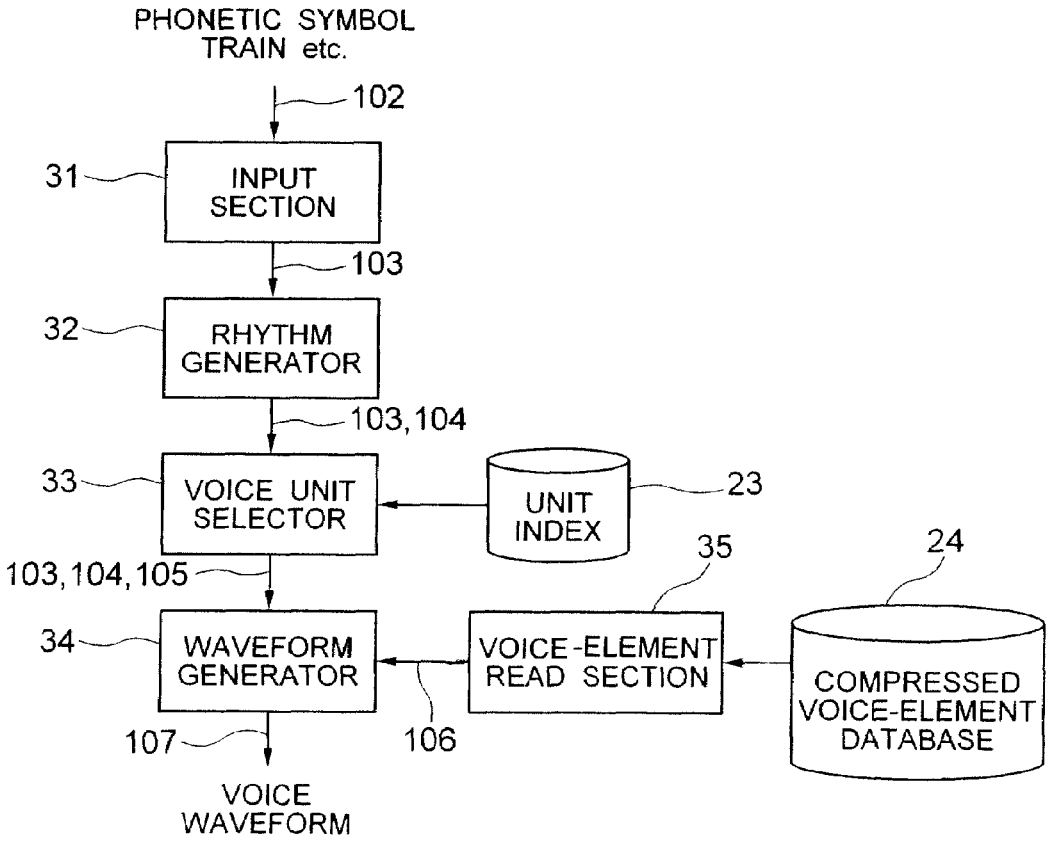
FIG. 3 is a block diagram of a voice rule-synthesizer for synthesizing a voice waveform based on the data generated by the compressed voice-element data generator of FIG. 1.

Referring to FIG. 3, a voice rule-synthesizer using the voice-element data obtained by the compressed voice-element generator shown in FIG. 1 includes an input section 31, a rhythm generator 32, a unit selector 33, a waveform generator 34 and a voice-element read section 35.

The input section 31 receives information 102, such as a phonetic symbol train, to generate voice information 103 including the voice structure for specifying the pronunciation needed for synthesis of a voice waveform. The input section 31 delivers the voice information 103 to the rhythm generator 32.

The rhythm generator 32 receives the voice information 103 to add thereto rhythm information 104 such as including tone, tempo and intonation, delivering the voice information 103 and the rhythm information 104 to the unit selector 33. The unit selector 33 refers to the unit index 23 based on the voice information 103 and the rhythm information 104 to select an optimum unit series and add such information as unit selection information 105 to the voice information 103 and the rhythm information 104.

The waveform generator 34 has a function for editing the voice element based on the unit selection information 105 to create a synthesized voice waveform 107. The voice-element read section 35 has a function for reading specified compressed voice element from the voice-element database 24 and delivering the voice element 106 to the waveform generator 34 after extension thereof.

The waveform generator 34 determines the units stored in the voice-element database 24 based on the unit index 23 to specify the head frame number and the number of frames following the head frame.

The voice-element read section 35 receives information for the head frame number and the number of frames from the waveform generator 34, resets the historical data, consecutively develops the bit stream train of the data in the specified frames starting from the head frame number to the end frame specified by the number of frames, and generates extended voice element 106 to deliver the same to the waveform generator 34. The waveform generator 34 synthesizes voice waveform by using the extended voice element based on the information for the offset B-A of the voice element to generate a synthesized voice waveform.

Figures 4A, 4B:
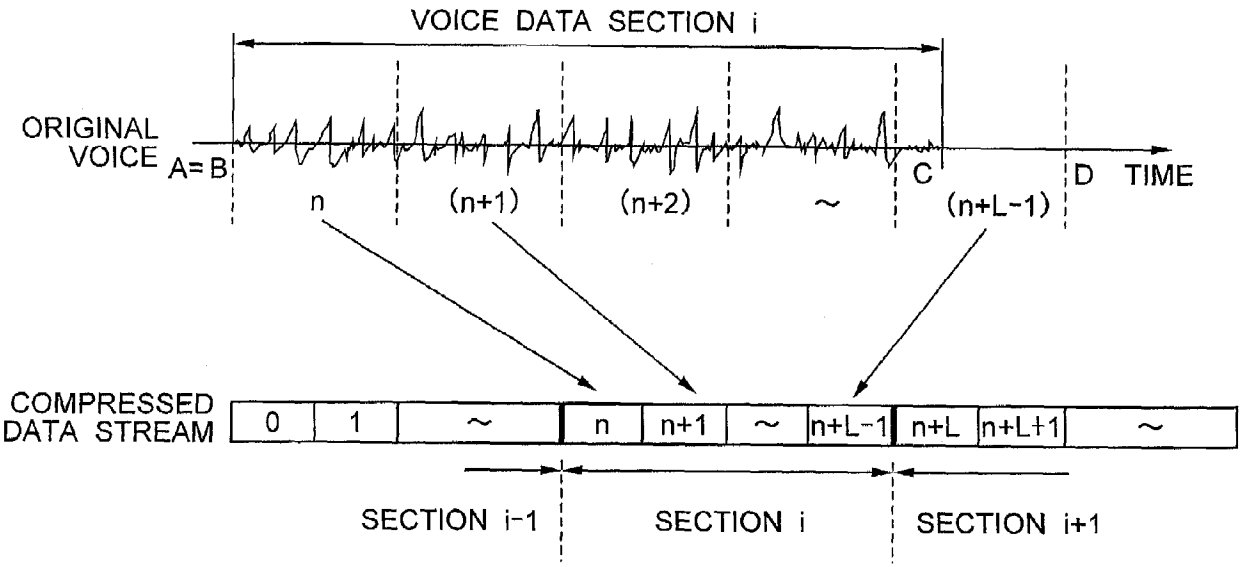
FIG. 4A illustrates a waveform diagram of the voice data stored in the voice database.

Referring to FIGS. 4A and 4B, illustrating, respectively, the original voice data and the compressed voice elements, the compression by a compressed voice element data generator according to a second embodiment of the present invention will be described. The structure of the compressed voice-element generator of the present embodiment is similar to that shown in FIG. 1.

In the present embodiment, the starting point B of the voice data section stored in the voice-element database 24 is adjusted to be coincident with the beginning point A of the head frame n. This configuration allows the offset information (B-A) to be unnecessary. This embodiment operates similarly to the voice-element read section of the first embodiment, whereas the waveform generator 34 of the present embodiment need not consider the offset of the voice element data with respect to the beginning of the head frame and can use the voice element data for synthesis from the beginning of the head frame.

Referring to FIG. 5 illustrating the original voice data and the compressed voice elements, the compression by a compressed voice element data generator according to a third embodiment of the present invention will be described. The structure of the compressed voice-element generator of the present embodiment is similar to that shown in FIG. 1.

Figure 5A:
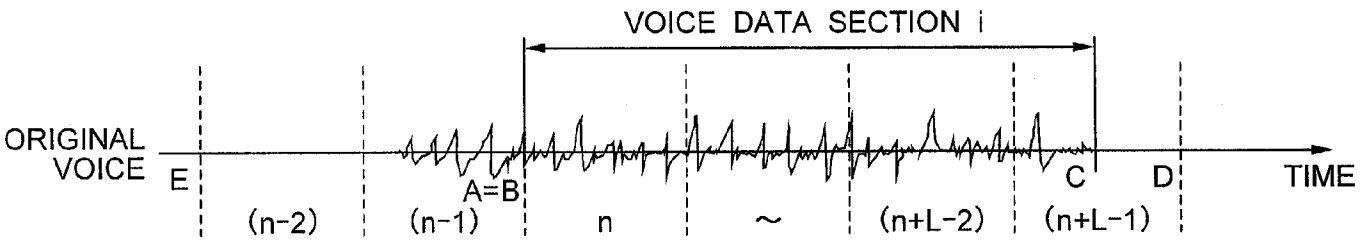
FIG. 5A illustrates a waveform diagram of the voice data stored in the voice database.
Figure 5B:
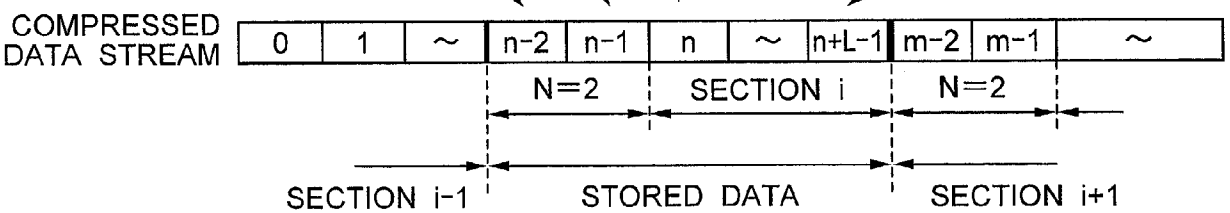
FIG. 5B illustrates a data diagram of compressed voice-element data stored in the compressed voice-element database, both the diagrams being according to a third embodiment of the present invention.

Referring to FIGS. 5A and 5B, illustrating, respectively, the original voice data and the compressed voice elements, the compression by a compressed voice element data generator according to a third embodiment of the present invention will be described. The structure of the compressed voice-element generator of the present embodiment is similar to that shown in FIG. 1.

In a voice rule-synthesizer using the voice element generated by the compressed voice-element data generator of the present embodiment, the waveform generator 34 receives information for the frame number n−N and the number of frames necessary for extension. The voice-element read section 35 reads the voice element based on these data, starting from the frame n−N to the frame (n+L−1+N). The voice-element read section 35 extends the data from the frame number (n−N) to the frame number (n+L−1+N), and discards the data in the frames outside the voice data section. The waveform generator 34 receives the extended voice element corresponding to the frames n to n+L−1. In this configuration, the compression scheme using the historical data alleviates the adverse influence caused by the null historical data, as in the case of the second embodiment, at the beginning of the head frame n.

Figure 6A:
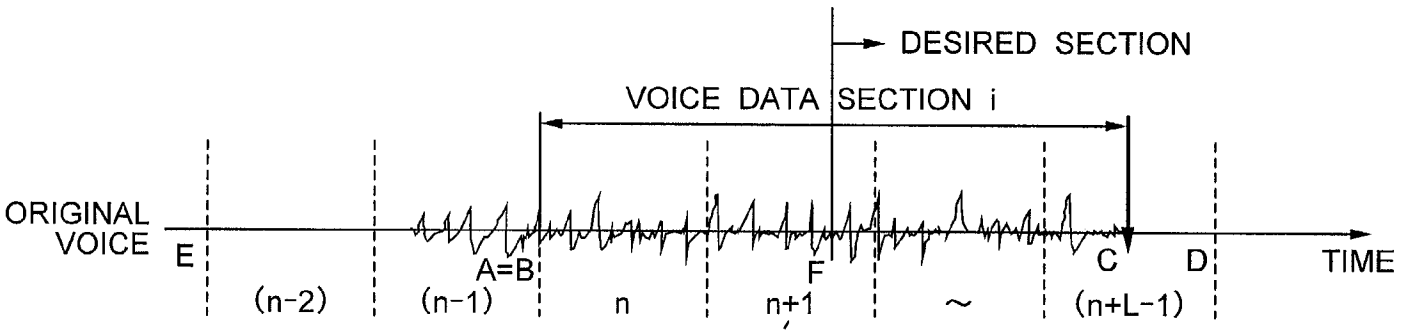
FIG. 6 is a waveform diagram of the voice data stored in the voice database, and a data diagram of compressed voice-element data stored in the compressed voice-element database, both the diagrams being according to a fourth embodiment of the present invention.
Figure 6B:
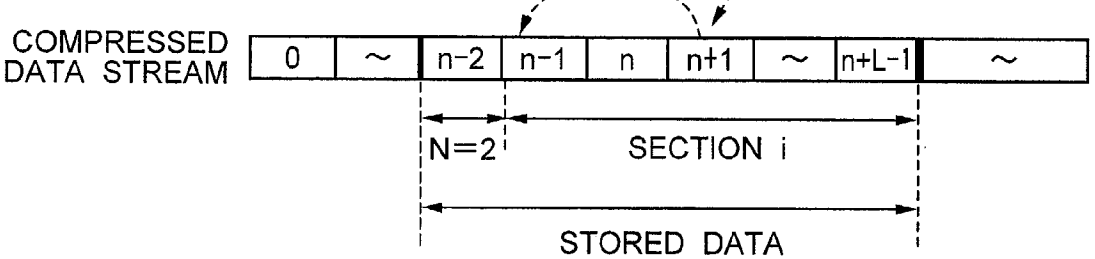

Referring to FIGS. 6A and 6B illustrating the original voice data and the compressed voice elements, respectively, the compression by a compressed voice element data generator according to a fourth embodiment of the present invention will be described. The structure of the compressed voice-element data generator and the voice rule-synthesizer of the present embodiment are similar to those shown in FIGS. 1 and 3, respectively.

In the present embodiment, the waveform generator 34 needs voice data from the point F which resides behind the starting point B of the voice data section (i) stored in the voice-element database 24, which is coincident with the beginning point A of the head frame n.

The information of the starting frame number (n−2) and the number of the frames to be used by the waveform generator 34 is delivered to the voice-element read section 35, which extends the voice-element data of the frames starting from the (n−2)-th frame. In this case, the data extended for the frames n and n−1 are discarded, because these frames do not include the voice data section to be used.

Figure 7A:
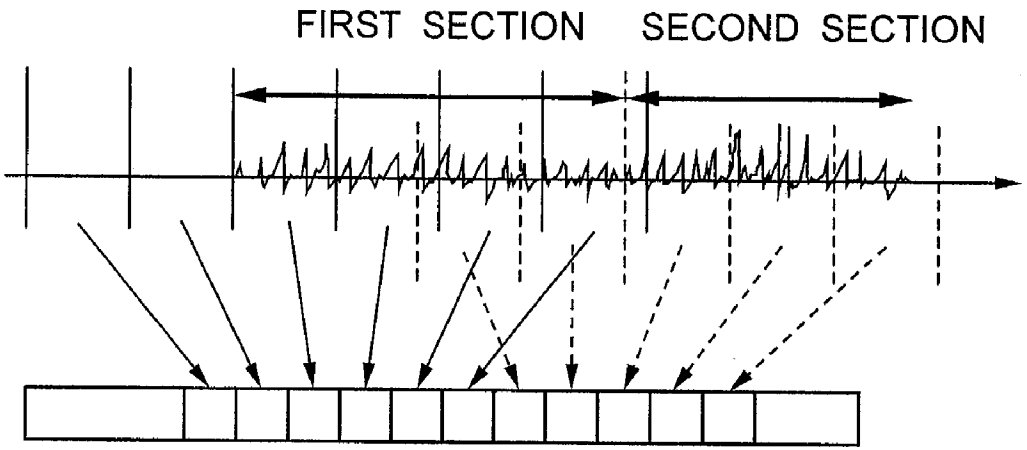
FIGS. 7A and 7B each illustrates a waveform diagram of the voice data stored in the voice database, and a data diagram of compressed voice-element data stored in the compressed voice-element database, FIG. 7A corresponding to a comparative example, FIG. 7B corresponding to a fifth embodiment of the present invention.
Figure 7B:
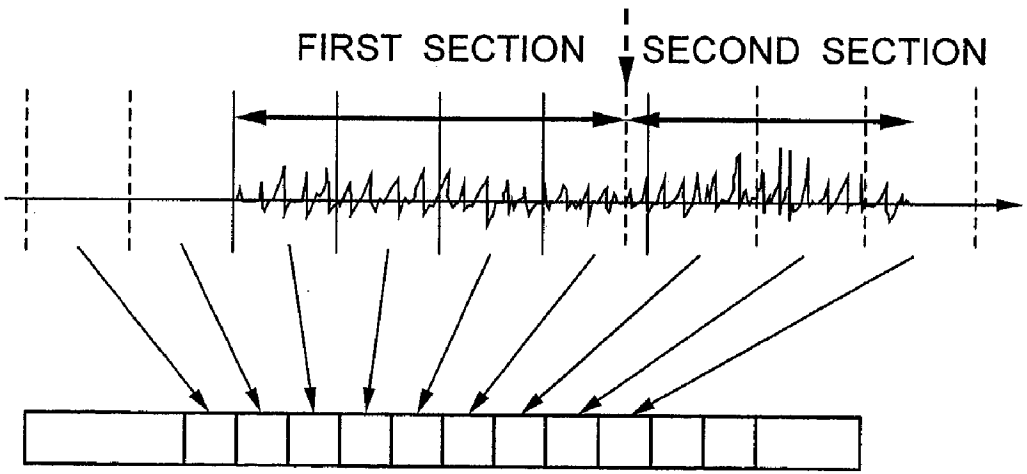

Referring to FIGS. 7A and 7B each illustrating the original voice data and the compressed voice element, the compression and the extension by a compressed voice element data generator and a voice rule-synthesizer according to a fifth embodiment of the present invention will be described. The structure of the compressed voice-element generator and the voice rule-synthesizer of the present embodiment are similar to those shown in FIGS. 1 and 3.

In the present embodiment, the original voice data includes two consecutive voice data sections, as shown in FIGS. 7A and 7B. After the unit generator 13 detects these data sections, the compressed voice-element generator regards the two voice data sections as a single voice data section, compressing the voice data sections by a single processing.

If these data sections are processed as two separate data sections, as shown in FIG. 7A, the boundary between the data sections has duplicated voice data in the compressed voice-element database 24. By regarding the two voice data sections as a single data section, as shown in FIG. 7B, the compressed data can be read out regardless of the data sections without using a particular processing scheme.

Figure 8A:
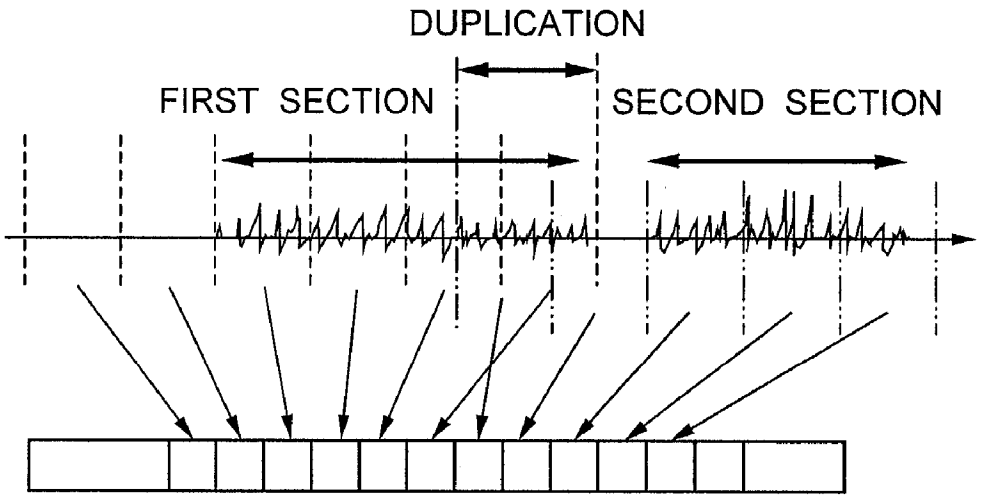
FIGS. 8A and 8B each illustrates a waveform diagram of the voice data stored in the voice database, and a data diagram of compressed voice-element data stored in the compressed voice-element database, FIG. 8A corresponding to a comparative example, FIG. 8B corresponding to a sixth embodiment of the present invention.
Figure 8B:
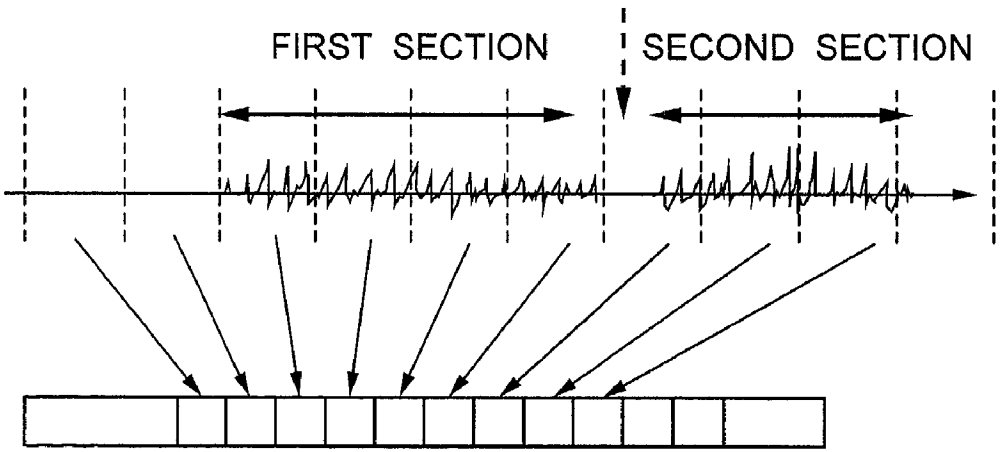

Referring to FIGS. 8A and 8B each illustrating the original voice data and the compressed voice element, the compression and the extension by a compressed voice element data generator and a voice rule-synthesizer according to a sixth embodiment of the present invention will be described. The structure of the compressed voice-element generator and the voice rule-synthesizer of the present embodiment are similar to those shown in FIGS. 1 and 3.

In the present embodiment, the original voice data includes two voice data sections with a small space disposed therebetween, the space being shorter than the number of prescribed frames N to be used for compression, as shown in FIGS. 8A and 8B. After the unit generator 13 detects these data sections, the compressed voice-element generator regards the two voice data sections as a single voice data section, compressing the voice data sections by a single processing operation.

If these data sections are processed as two separate data sections, as shown in FIG. 8A, the boundary between the data sections has duplicated voice data in the compressed voice-element database 24. By regarding the two voice data sections as a single data section, as shown in FIG. 8B, the compressed data can be read out regardless of the data sections without using a particular processing scheme. In this case, the offset (B-A) is dispensable, because the starting point of the second data section is generally inconsistent with the beginning point of the frame.

In a compressed voice element data generator and a voice rule-synthesizer according to a seventh embodiment of the present invention, the prescribed number N for compression is determined dynamically based on the compression distortion, differently from the second through sixth embodiments. More specifically, the data stored for determining the number N in this embodiment includes a minimum number $N_{min}$, a maximum number $N_{max}$ and a maximum allowable distortion $D_{max}$.

The unit generator 12 changes the number N between $N_{min}$ and $N_{max}$, allows the compression section 13 to proceed for compression, and calculates the compression distortion. The compression section 13 detects an optimum number for the N which generates a maximum distortion yet residing within the maximum allowable distortion $D_{max}$. The compressed voice-element data corresponding to the optimum number is stored in the voice-element database 24, whereas the unit generator 13 stores the optimum number for the N in the unit index 23.

The voice rule-synthesizer of the present embodiment, after the voice-element read section 35 reads out information for the optimum number N stored in the unit index 23, synthesizes voice waveform based the optimum number for the N similarly to the second through sixth embodiments.

In the above embodiment, the voice element is compressed in a fixed-length format while using a constant-bit-rate compression scheme to obtain a fixed frame length after the compression. In addition, the compression uses the historical voice data to raise the compression rate. Thus, synthesized voice data having a high voice quality can be obtained while using a storage device having a small storage capacity, thereby reducing the cost for the voice data synthesis.

As described above, if it is considered that the compression distortion is larger at the start point of the voice data section, the compression is effected from the preceding data section ahead of the desired data section. In the extension, the preceding data section is used for extension and then discarded for alleviating the distortion at the start of the data section.

Since the above embodiments are described only for examples, the present invention is not limited to the above embodiments and various modifications or alterations can be easily made therefrom by those skilled in the art without departing from the scope of the present invention.

What is claimed is:

1. A method for synthesizing a voice waveform comprising the steps of:

compressing a voice-element data in a fixed-length scheme by using data of at least one preceding frame and/or at least one succeeding frame during compressing a voice data section, to generate compressed voice-element data;

expanding said compressed voice-element data of each voice data section and of said at least one preceding frame and/or said at least one succeeding frame to generate an extended voice-element data;

discarding said expanded voice-element data of said at least one preceding frame and/or said at least one succeeding frame; and synthesizing the remaining voice-element data after said discarding step.

2. The method according to claim 1, further comprising the step of storing said compressed voice-element data while arranging said compressed voice-element data of a plurality of voice data sections in a data stream.

3. The method according to claim 1, wherein said data of at least one preceding frame includes data at a beginning point of a head frame of said at least one preceding frame.

4. The method according to claim 1 wherein said data of at least one preceding frame includes data at a starting point of voice data.

5. A voice rule-synthesizer comprising:

a compression section for compressing a voice-element data in a fixed-length scheme by using data of at least one preceding frame and/or at least one succeeding frame during compressing a voice data section, to generate compressed voice-element data;

an expanding section for expanding said compressed voice-element data of each voice data section and of said at least one preceding frame and/or said at least one succeeding frame to generate an extended voice-element data;

a discarding section for discarding said expanded voice-element data of said at least one preceding frame and/or said at least one succeeding frame; and a synthesizing section for synthesizing the remaining voice-element data after said discarding step.

6. The voice rule-synthesizer according to claim 5, further comprising a storage section for storing said compressed voice-element data while arranging said compressed voice-element data of a plurality of voice data sections in a data stream.

7. The voice rule-synthesizer according to claim 5, wherein said data of at least one preceding frame includes data at a beginning point of a head frame of said at least one preceding frame.

8. The voice rule-synthesizer according to claim 5 wherein said data of at least one preceding frame includes data at a starting point of voice data.

9. A voice rule-synthesizer comprising:

a compression section receiving original voice data for compressing voice-element data in a fixed-length scheme by using data of at least one preceding frame and/or at least one succeeding frame during compressing a voice data section, to generate compressed voice-element data;

a compressed voice-element database for storing said compressed voice-element data, said database storing a single data stream including a plurality of consecutive voice data sections each stored as a plurality of frames;

a voice-element data read section for reading and expanding compressed voice-element data of a voice data section and of said at least one preceding frame and/or said at least one succeeding frame stored in said database to generate an expanded voice-element data, said voice-element data read section discarding said expanded voice-data for said at least one preceding frame and/or said at least one succeeding frame; and a synthesizer for synthesizing the remaining expanded voice-element data after said expanded voice-data for said at least one preceding frame and/or said at least one succeeding frame have been discarded.

10. A method for encoding input samples, comprising:

preparing at least one virtual preceding frame: and encoding each frame of said input samples by using at least one preceding frame preceding to said each frame, said at least one preceding frame including said at least one virtual preceding frame used during encoding a starting frame of said input samples.

11. The method according claim 10, wherein said virtual preceding frame has a zero amplitude.

12. The method according to claim 10, wherein said each frame has a fixed length.

13. The method according to claim 12, wherein a last frame of said input samples is encoded by using a remainder of said samples of said last frame, said remainder having a zero amplitude.

14. The method of claim 13, further comprising storing data obtained by said encoding and information of a duration of said input samples.

15. A method for decoding encoded data, comprising:

decoding data obtained by encoding each frame of input samples by using at least one preceding frame preceding to said each frame, said at least one preceding frame including at least one virtual preceding frame used during encoding a starting frame of said input samples; and discarding said virtual samples of said virtual preceding frame from decoded data obtained by said decoding.

16. The method according to claim 15, wherein said virtual preceding frame has a zero amplitude.

17. The method according to claim 15, wherein said each frame has a fixed length.

18. The method according to claim 17, wherein a last frame of said input samples is encoded by using a remainder of said samples of said last frame, said remainder having a zero amplitude.

19. The method according to claim 18, further comprising discarding said remainder of said samples by using information of a duration of said input samples.

* * * * *